US009793656B2

(12) United States Patent
Fabre et al.

(10) Patent No.: US 9,793,656 B2
(45) Date of Patent: Oct. 17, 2017

(54) SHIELDED ELECTRICAL CONNECTOR AND PRODUCTION METHOD THEREOF

(71) Applicant: Delphi International Operations Luxembourg S.A.R.L., Bascharage (LU)

(72) Inventors: Jean Fabre, Chartres (FR); Gilles Schmitt, Senantes (FR)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 0 days.

(21) Appl. No.: 15/314,971

(22) PCT Filed: Jun. 10, 2015

(86) PCT No.: PCT/EP2015/062970

§ 371 (c)(1),
(2) Date: Nov. 30, 2016

(87) PCT Pub. No.: WO2015/189289

PCT Pub. Date: Dec. 17, 2015

(65) Prior Publication Data

US 2017/0187150 A1 Jun. 29, 2017

(30) Foreign Application Priority Data

Jun. 12, 2014 (FR) ..... 14 55366

(51) Int. Cl.

| | |
|---|---|
| ***H01R 9/03*** | (2006.01) |
| ***H01R 13/6593*** | (2011.01) |
| ***H01R 9/05*** | (2006.01) |
| ***H01R 13/52*** | (2006.01) |
| ***H01R 13/58*** | (2006.01) |

(52) U.S. Cl.
CPC ..... *H01R 13/6593* (2013.01); *H01R 9/05* (2013.01); *H01R 13/52* (2013.01); *H01R 13/58* (2013.01)

(58) Field of Classification Search
CPC ..... H01R 13/6593; H01R 9/05; H01R 13/52; H01R 13/58
USPC ..... 439/607.01, 607.55
See application file for complete search history.

(56) References Cited

U.S. PATENT DOCUMENTS

| | | | |
|---|---|---|---|
| 2010/0151721 | A1 | 6/2010 | Tyler |
| 2010/0210140 | A1 | 8/2010 | Metral et al. |
| 2014/0110165 | A1 | 4/2014 | Ishikawa et al. |

FOREIGN PATENT DOCUMENTS

| | | | |
|---|---|---|---|
| EP | 2045884 | A1 | 4/2009 |
| EP | 2728679 | A1 | 5/2014 |
| FR | 2740914 | A1 | 5/1997 |
| FR | 3022410 | A1 | 12/2015 |
| WO | 2011124562 | A1 | 10/2011 |

*Primary Examiner* — Khiem Nguyen
(74) *Attorney, Agent, or Firm* — Robert J. Myers

(57) ABSTRACT

The invention relates to a shielded connector for a motor vehicle. The connector comprises at least one casing shielding element. The shielding element includes a cable outlet portion provided with a plurality of resilient tabs that are integral with the shielding element. The tabs include a contact zone in electrical contact with a ferrule crimped to a shielding braid of a cable. The contact zone is maintained pressed against the shielding braid by means of a removable clamping ring.

11 Claims, 3 Drawing Sheets

SHIELDED ELECTRICAL CONNECTOR AND PRODUCTION METHOD THEREOF

CROSS-REFERENCE TO RELATED APPLICATION

This application is a national stage application under 35 U.S.C. §371 of PCT Application Number PCT/EP2015/062970 having an international filing date of Jun. 10, 2015, which designated the United States, said PCT application claiming the benefit of priority under Article 8 of the Patent Cooperation Treaty to French Patent Application No. 1455366, now French Patent No. 3022410, having a filing date of Jun. 12, 2014, the entire disclosure of each of which are hereby incorporated herein by reference.

TECHNICAL FIELD OF THE INVENTION

The invention relates to the field of electromagnetically shielded electrical connectors. In many applications, and in particular for example in the field of electrical power connectors for rechargeable electric or hybrid motor vehicles, the cables and electrical connections must be electromagnetically shielded.

BACKGROUND OF THE INVENTION

In effect, due to the electrical powers involved in these applications, the shielding of the cables and connectors is essential in order to avoid interferences. It is thus important to assure continued shielding in the cable bundles involved in these applications and in particular at the connectors present in these bundles.

Various solutions have been developed for this purpose. As described for example in document WO 2011/124562 A1, a shielded connector for a motor vehicle has been designed which comprises an electrically insulating inner casing with at least one cavity accommodating a contact electrically connected to an electrical cable provided with a shielding braid. At least one casing shielding element, which is electrically conductive and which has a cable outlet portion, is placed at least partially around the casing interior. This type of connector, although capable of satisfying the technical requirements, can be difficult to repair.

Thus, such connectors must be produced in an effective way and at a lower cost whilst satisfying demanding quality standards and allowing any potential repairs of the cable.

The quality of the electrical connection between the shielding braid of a cable and the shielding element of the casing of the connector mounted thereon, as well as the robustness of the cable outlet portion of this shielding element are particularly critical in this regard. In fact, the cable at the connector outlet can be subjected to strong stresses and vibrations.

BRIEF SUMMARY OF THE INVENTION

The object of the invention is to produce a shielded connector that at least partially satisfies the above-mentioned demands.

This objective is achieved by a connector of the above-indicated type, in which at least one resilient tab has a contact zone kept pressed against the shielding braid by means of a removable clamping ring (the term "removable" in this document being relative to the position on the tab(s)—in other words, the clamping ring can be removed from its position in which it at least partially covers the tab(s), but cannot be removed completely or easily from the cable).

Thus, the elasticity of the tab can accommodate the movements of the cable at the connector outlet whilst avoiding mechanical breakage of the casing shielding element and interruption of the electrical continuity between the casing shielding element and the shielding braid. This arrangement makes the connection between the casing shielding element and the cable flexible, thus freeing the casing shielding element of excessive stresses.

In addition, the clamping ring makes it possible to hold the resilient tab in contact with the shielding braid. The fact that the clamping ring is also removable makes it easily possible to release the connection between the casing shielding element and the shielding braid, thus providing the possibility of repairing just the cable more easily, without having to replace other elements of the connector.

This connector can comprise any of the following features, considered individually or in combination:

- it comprises a seal around the cable and in contact with the clamping ring; in this case, the clamping ring forms a stop or surface, against which the seal can be compressed;
- it comprises an outer ferrule crimped to the shielding braid and against which the resilient tab is pressed by the clamping ring; in this case, the electrical connection between the shielding element and the shielding braid is reinforced by the fact that the tab is in contact with a rigid element;
- it comprises an inner ferrule placed around the shielding braid and over which the shielding braid is folded; this arrangement makes it possible to secure the crimping of the outer ferrule and to ensure an improved holding of the outer ferrule on the cable as well as an optimized electrical connection between the shielding braid and the rigid ferrules between which said braid is sandwiched.

In accordance with another aspect, the invention relates to a method for assembling a shielded connector for motor vehicles, comprising the following steps:

- providing an electrical cable provided with a shielding braid,
- stripping a portion of the shielding braid in the proximity of one of the ends of the electrical cable,
- fixing at least one contact at the end of the electrical cable located in the vicinity of the stripped portion of the shielding braid,
- inserting the contact into an electrically insulating inner casing, and
- placing at least one casing shielding element, which is electrically conductive, on the inner casing, this shielding element comprising a cable outlet portion.

The cable outlet portion is provided with at least one resilient tab integral with the shielding element, which tab extends in line with the portion of the stripped shielding braid. A removable clamping ring can then be returned over the tab, above the portion of the stripped shielding braid.

This method makes it possible to prepare the cable and the elements which make it possible to ensure the continuity of shielding in the connector solely on the cable. There are no elements involved with the shielding function that are to be assembled in the rest of the connector.

This method may also include any of the following features, considered individually or in combination:

an outer ferrule is crimped to the cable at the portion of the stripped shielding braid, and the clamping ring presses the tab against the outer ferrule, an inner ferrule is placed on the cable, over the portion of the stripped shielding braid, then the shielding braid is folded back over the inner ferrule, before the outer ferrule is crimped to the inner ferrule, a seal is placed around the cable and against the clamping ring.

BRIEF DESCRIPTION OF THE SEVERAL VIEWS OF THE DRAWING

Further features and advantages of the invention will become clear upon reading the following detailed description and studying the accompanying drawings, in which.

DETAILED DESCRIPTION OF THE INVENTION

Figure 1:
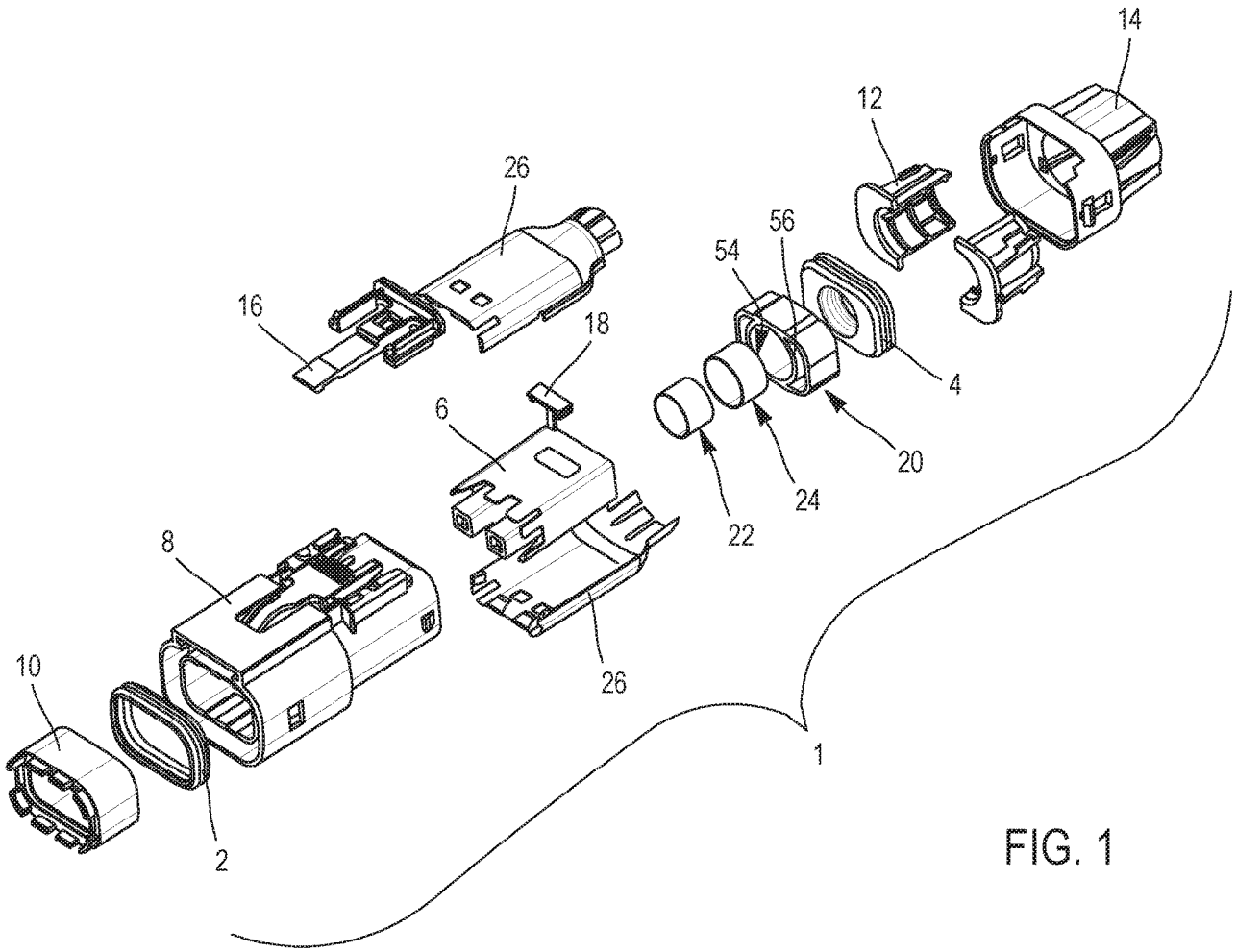
FIG. 1 schematically shows a perspective exploded view of an embodiment of a connector according to the invention.

FIG. 1 illustrates a non-limiting example of an embodiment of the connector 1. In accordance with this example, the connector 1 includes an interfacial coupling 2 and a wired coupling 4, both made of an elastomer material, an inner casing 6, an outer casing 8, a device 10 for holding the interfacial coupling 2, two compression half-shells 12, a cover 14, a device 16 for assuring the connection ("CPA" or Connection Positioning Assurance), a secondary locking device 18, and a spacer 20, all molded from an electrically insulating plastics material. The connector 1 also includes an inner ferrule 22, an outer ferrule 24, and casing shielding elements 26, all made of metal.

Figure 5A:
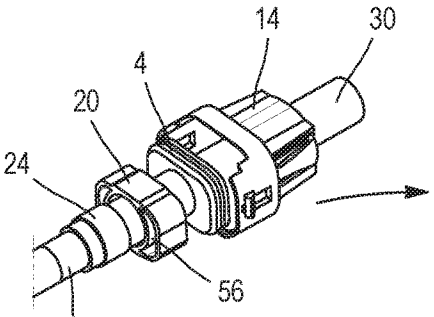
FIGS. 5A to 5G show a sequence of steps of the assembly method according to the invention.
Figure 5B:
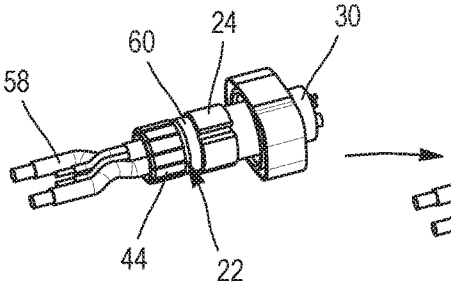
Figure 5C:
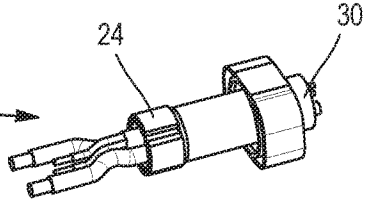
Figure 5D:
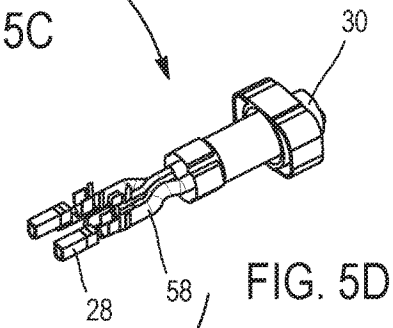

The connector 1 further includes contacts 28 electrically connected to a cable 30 (see FIG. 5D).

Figure 2:
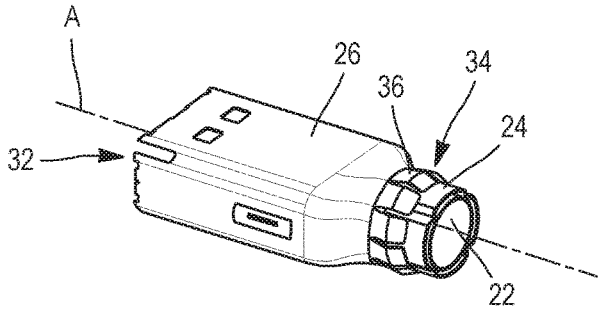
FIG. 2 schematically shows a perspective view of the shielding of the connector of FIG. 1.

FIG. 2 shows more particularly how the inner ferrule 22 and outer ferrule 24 are arranged with the casing shielding elements 26. The casing shielding elements 26, of which there are two in accordance with this example, are produced for example by stamping and cutting from a metal sheet. They are nested with one another to form a cage extending along a longitudinal axis A, between an open end 32 toward the connection interface and an opposite end comprising a cable outlet portion 34.

This cable outlet portion 34 has a substantially tubular form, which is symmetrical about the longitudinal axis A. It comprises a plurality of tabs 36 or resilient blades integral with the casing shielding elements 26. For example, there are ten of these tabs 36 distributed uniformly about the longitudinal axis A. However, it should be noted that the tabs rest on an outer ferrule 24 without any crimping operation having been performed at the casing shielding elements 26 at the cable outlet portion 34. This thus substantially limits the level of stress exerted on the casing shielding elements 26. This is also allows manual assembly and facilitates repair operations.

Figure 3:
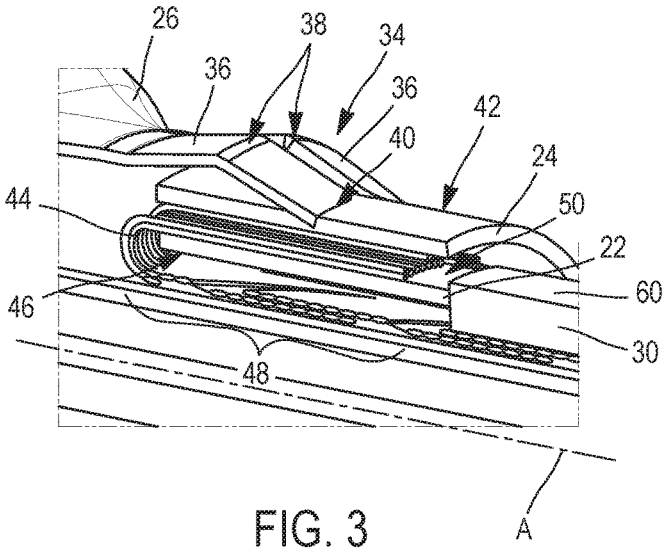
FIG. 3 schematically shows, in a perspective and sectional view, a detail of the connection between a shielding element of the connector and the shielding braid of the cable.

As has been shown in greater detail in FIG. 3, each tab 36 has a curved form. In other words, each tab 36 becomes distanced progressively from the longitudinal axis A as it extends from the casing shielding element 26 to which it is connected, as far as a peak 38. Then, proceeding from this peak 38, in the direction of its free end 40, the tab moves closer toward the longitudinal axis again. The diameter of the circle described at the free ends of the tabs 36, when these are not stressed, is smaller than the outer diameter of the outer ferrule 24. Thus, the free ends 40 of the tabs 36 form contact zones which rest on and exert a contact force onto the outer surface 42 of the outer ferrule 24, when this is housed in the cable outlet portion 34.

The inner ferrule 22 has an outer diameter smaller than the inner diameter of the outer ferrule 24. Thus, the inner ferrule 22 is placed against the cable 30, above a stripped portion 48 of the shielding braid 44. The shielding braid 44 is thus in contact with the inner face 46 of the inner ferrule 22. The shielding braid 44 is also folded over, i.e. turned back on itself, so as to be in contact with the outer surface 50 of the inner ferrule 22. The outer ferrule 24 is threaded on above the stripped portion 48 of the shielding braid 44 resting on the inner ferrule 22, against which it is crimped. The outer surface 42 of the outer ferrule 24 is essentially smooth (with no shielding braid visible). Thus, the free ends 40 of the tabs 36 come to rest on this smooth surface and produce reliable and long-lasting electrical contact, even if these free ends 40 start to rub against this outer surface 42 of the outer ferrule 24 during the service life of the connector 1.

Figure 4A:
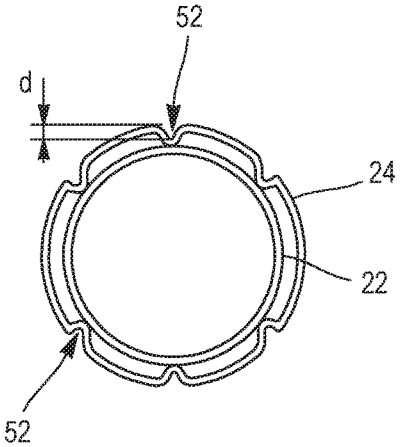
FIGS. 4A and 4B schematically show, for two different ferrule diameters, the crimping of the outer ferrule at the stripped end of the cable.
Figure 4B:
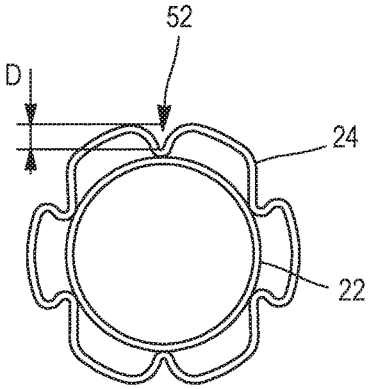

As shown in FIG. 4, the configuration of the resilient tabs 36 presented above makes it possible to accommodate a number of diameters of cables 30, with a limited number of ferrules of different diameters. For example, in FIG. 4A, an inner ferrule 22 of large diameter (for example 10.1 mm inner diameter and 10.9 mm outer diameter) can be used for a cable of relatively large diameter, and the crimping teeth 52 extending between the outer ferrule 24 (for example 12.3 mm inner diameter and 13.1 mm outer diameter) and the inner ferrule 22 have a relatively small dimension d (for example d=0.7 mm). As shown in FIG. 4B, an inner ferrule 22 of small diameter (for example 8.6 mm inner diameter and 9.4 mm outer diameter) can be used for a cable having a relatively small diameter, whilst keeping the same outer ferrule 24 as for the case illustrated in FIG. 4A. By contrast, in this case, the crimping teeth 52 extending between the outer ferrule 24 and the inner ferrule 22 have a larger dimension D (D=1.45 mm). It should therefore be noted that when the outer diameter of the cable 30 varies, it is sufficient to adapt the diameter of the inner ferrule 22 without changing the diameter (before crimping) of the outer ferrule 24.

Figure 5E:
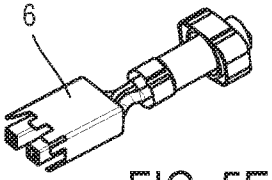
Figure 5F:
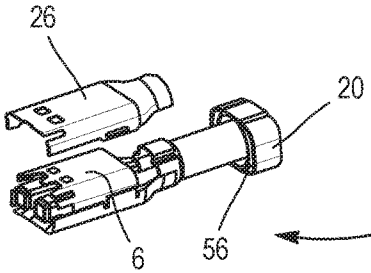
Figure 5G:
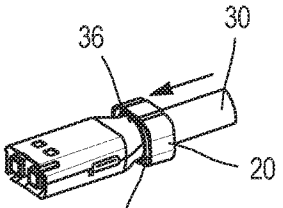

As shown in FIG. 1, the spacer 20 has an inner tubular surface 54 forming a clamping ring 56. The spacer 20 (and therefore its clamping ring 56) is movable along the cable 30 and can be positioned removably above the tabs 36 (FIG. 5G). The inner surface 54 of the clamping ring 56, by pressing against the peak 38 of the tabs 36, exerts a force which presses and holds the free ends 40 of the tabs 36 in contact with the outer surface 42 of the outer ferrule 24. In other words, the clamping ring 56 exerts a force on the resilient tab 36, primarily at the peak 38 thereof, radially, in the direction of the cable 30. Because the tabs 36 are on the one hand inclined relative to the outer surface 42 of the outer ferrule 24 and on the other hand are resilient, the clamping ring 56 (of which the inner diameter is slightly greater than the outer diameter of the outer ferrule, but smaller than the diameter described at the peaks 38 of the tabs 36) can be displaced relatively easily along the cable 30, then over the tabs 36.

In accordance with a variant, the clamping ring 56 and the spacer are two separate elements.

FIG. 5 illustrates, in greater detail, the assembly of the connector 1 comprising the connection between the casing shielding elements 26 and the shielding braid 44. Thus, in FIG. 5A, the cover 14, the wired coupling 4, the spacer 20, and the inner ferrule 22 and outer ferrule 24 have been threaded onto the cable 30 (the two compression half-shells 12 can be placed on the cable 30 subsequently). It should be noted that the inner ferrule 22 and outer ferrule 24 can assume any angular position around the cable 30, which simplifies the method for assembling the connector according to the invention.

It can be seen that the clamping ring 56 and the spacer 20 on which the clamping ring is mounted contribute to forming a stop or surface against which the wired coupling 4 can be compressed by the two compression half-shells 12 and the cover 14. As shown in FIG. 5B, a portion of the inner insulation of the cable 30 is then removed in the proximity of one of its ends so as to free the wires 58 of the cable 30. A portion of the outer insulation 60 of the cable 30 is also removed so as to strip the shielding braid 44, which is then folded over on the inner ferrule 22. The outer ferrule 24 can then be returned and crimped to the portion of the shielding braid folded over the inner ferrule 22 (FIG. 5C). Contacts 28 are then crimped to the ends, previously cleared and stripped, of the wires 58 of the cable 30 (FIG. 5D). These contacts 28 are inserted into the inner casing 6 (FIG. 5E). The two casing shielding elements 26 are returned to the inner casing 6 (FIG. 5F). The tabs 36 cover the outer ferrule 24. The flexibility of the tabs makes it possible to optimize the performance under vibration without affecting the shielding performance. For example, vibration levels of 42 G sine can be reached, that is to say substantially 17 G RMS, instead of 25 G sine of the existing shielded connectors of this type. It should be noted that the casing shielding elements 26 and their tabs 36 are not crimped to the outer ferrule, which makes disassembly and repair operations possible. The two casing shielding elements 26 are nested one inside the other, and the clamping ring 56 of the spacer 20 is returned to the tabs 36 (FIG. 5G).

The end of the cable 30 thus prepared and shielded can potentially be stored and/or transported before being introduced into the outer casing 8 and assembled with the other elements of the connector 1.

The invention claimed is:

1. A shielded connector for a motor vehicle, comprising:

an electrically insulating inner casing defining a cavity accommodating a contact electrically connected to an electrical cable provided with a shielding braid;

a casing shielding element, which is electrically conductive, placed at least partially around the inner casing, said casing shielding element comprising a cable outlet portion provided with a resilient tab integrally formed with the casing shielding element, said resilient tab electrically connected to the shielding braid;

a removable clamping ring configured to exert a radial force on the resilient tab; and an outer ferrule crimped to the shielding braid and against which the resilient tab is pressed by the clamping ring, wherein a free end of the resilient tab forms a contact zone which rests on and exerts a contact force onto an outer surface of the outer ferrule when the free end is accommodated in the cable outlet portion.

2. The shielded connector according to claim 1, further comprising a seal around the electrical cable and in contact with the clamping ring.

3. The shielded connector according to claim 1, wherein a diameter of the free end of the resilient tab is smaller than an outer diameter of the outer ferrule.

4. The shielded connector according to claim 1, wherein an outer surface of the outer ferrule is substantially smooth and the free end of the resilient tab rests on the outer surface.

5. The shielded connector according to claim 1, further comprising an inner ferrule placed around the shielding braid and over which the shielding braid is folded.

6. A shielded connector for a motor vehicle, comprising:

an electrically insulating inner casing defining a cavity accommodating a contact electrically connected to an electrical cable provided with a shielding braid;

a casing shielding element, which is electrically conductive, placed at least partially around the inner casing, said casing shielding element comprising a cable outlet portion-provided with a resilient tab integrally formed with the casing shielding element, said resilient tab electrically connected to the shielding braid;

a removable clamping ring configured to exert a radial force on the resilient tab;

an outer ferrule crimped to the shielding braid and against which the resilient tab is pressed by the clamping ring; and an inner ferrule placed around the shielding braid and over which the shielding braid is folded, wherein the outer ferrule comprises crimping teeth extending between the outer ferrule and the inner ferrule.

7. The shielded connector according to claim 6, wherein the crimping teeth are smaller than a diameter of the inner ferrule.

8. A method for assembling a shielded connector for motor vehicles, comprising the following steps:

providing an electrical cable provided with a shielding braid;

stripping a portion of the shielding braid in proximity of an end of the electrical cable;

fixing a contact at the end of the electrical cable located in a vicinity of the stripped portion of the shielding braid;

inserting the contact into an electrically insulating inner casing; and placing a casing shielding element, which is electrically conductive, on the inner casing, this casing shielding element comprising a cable outlet portion, wherein the cable outlet portion is provided with a resilient tab integral with the shielding element and extending in line with the stripped portion of the shielding braid, wherein a clamping ring is disposed above the stripped portion of the shielding braid, wherein the clamping ring is removable from the resilient tab, and wherein the resilient tab rests on an outer ferrule without any crimping operation having been performed on the casing shielding element at the cable outlet portion.

9. The method according to claim 8, wherein an outer ferrule is crimped to the electrical cable at the stripped portion of the shielding braid and the clamping ring presses the resilient tab against the outer ferrule.

10. The method according to claim 9, wherein an inner ferrule is placed on the electrical cable over the stripped portion of the shielding braid, the shielding braid is folded over the inner ferrule, and the outer ferrule is crimped to the inner ferrule.

11. The method according to claim 8, wherein a seal is placed around the electrical cable and against the clamping ring.

* * * * *